US007652212B2

(12) United States Patent
Stacy

(10) Patent No.: US 7,652,212 B2
(45) Date of Patent: Jan. 26, 2010

(54) INSULATED ELECTRICAL BUSHING AND METHOD OF PRODUCING THE SAME

(75) Inventor: Fabian Durand Stacy, Jackson, TN (US)

(73) Assignee: ABB Technology AG, Zurich (CH)

( * ) Notice: Subject to any disclaimer, the term of this patent is extended or adjusted under 35 U.S.C. 154(b) by 280 days.

(21) Appl. No.: 11/851,455

(22) Filed: Sep. 7, 2007

(65) Prior Publication Data

US 2008/0060835 A1 Mar. 13, 2008

Related U.S. Application Data

(60) Provisional application No. 60/842,768, filed on Sep. 7, 2006.

(51) Int. Cl.
*H01B 17/26* (2006.01)

(52) U.S. Cl. ..... 174/152 R; 174/153 R

(58) Field of Classification Search ..... 174/152 R, 174/153 R, 172, 31 R; 336/107, 137, 198; 439/371, 39

See application file for complete search history.

(56) References Cited

U.S. PATENT DOCUMENTS 2,806,080 A 9/1957 Corey
2,997,530 A 8/1961 Rosan
3,671,920 A 6/1972 Iantomo et al.
3,708,612 A * 1/1973 Saxon et al. ..... 174/142
3,784,733 A 1/1974 Farmer et al.
3,935,377 A 1/1976 Gamble
4,670,625 A * 6/1987 Wood et al. ..... 174/142
4,767,351 A 8/1988 Patel et al.
4,956,525 A 9/1990 Wilk
4,965,407 A * 10/1990 Hamm ..... 174/31 R
5,281,767 A 1/1994 West et al.
6,150,613 A * 11/2000 Bergstrom ..... 174/152 R
6,515,232 B2 2/2003 Forster
6,610,933 B2 8/2003 Baker et al.

FOREIGN PATENT DOCUMENTS

WO PCT/US2007/019340 4/2007

OTHER PUBLICATIONS

ABB Inc.,LV Busing Oil to Air Dry Insulation; 1ZUA2761-600en; Feb. 1998.

* cited by examiner

*Primary Examiner*—William H Mayo, III
(74) *Attorney, Agent, or Firm*—Paul R. Katterle

(57) ABSTRACT

The electrical bushing has an electrical conductor with a plurality of different embossment regions. An insulating body is molded over the electrical conductor.

19 Claims, 8 Drawing Sheets

INSULATED ELECTRICAL BUSHING AND METHOD OF PRODUCING THE SAME

CROSS-REFERENCE TO RELATED APPLICATION

This application claims the benefit of U.S. provisional patent application No. 60/842,768 filed on Sep. 7, 2006, which is hereby incorporated by reference in its entirety.

BACKGROUND OF THE INVENTION

This invention relates to insulated electrical bushings and more particularly to sealing systems for electrical conductors of insulated electrical bushings.

An insulated electrical bushing is used in an electrical device, such as a distribution transformer, to secure an electrical conductor to a housing of the device. Typically, an electrical conductor of an electrical bushing extends through an opening in a housing and is used to connect the internals of an electrical device to the outside world. A conventional electrical bushing includes an exterior insulating body having a mounting flange for securing the insulated electrical bushing to the exterior of a housing of an electrical device. A centrally-disposed electrical conductor is secured inside the insulating body and extends through an opening in the housing. An outer end of the electrical conductor protrudes from the exterior insulating body and is adapted for connection to an exterior connector device, such as an elbow connector. An inner end of the electrical conductor is connected to internal electrical components of the electrical device, such as windings, directly, or through a second electrical conductor.

An insulating body of an electrical bushing may be comprised of a ceramic material or a polymeric material. In many conventional electrical bushings composed of polymeric material, the electrical conductor is secured inside a pre-formed insulating body using an adhesive, O-rings and/or heat shrink tubing. An example of such a conventional insulated electrical bushing is disclosed in U.S. Pat. No. 6,515,232 to Forster. In the Forster patent, a conductor is disposed in a pre-formed insulating body comprised of glass-reinforced epoxy or a silica-filled cycloaliphatic resin system. Asphalt is poured between the conductor and the insulating body and O-rings and spring retaining gaskets are disposed at the top and bottom ends of the insulating body.

Some conventional insulated electrical bushings are formed in a much simpler manner by molding an insulating body directly over a conductor, such as is disclosed in U.S. Pat. No. 4,965,407 to Hamm and U.S. Pat. No. 5,281,767 to West et al. In the West et al. patent, the conductor is sandblasted before it is molded into the insulating body.

Although molding an insulating body directly over a conductor is much simpler than using O-rings and gaskets, the seal formed by a conventional over molding process tends to be less robust and often still requires the use of an adhesive.

It would therefore be desirable, to provide an electrical bushing that is simple to manufacture and has a robust seal. The present invention is directed to such an electrical bushing and a method for manufacturing the same.

SUMMARY OF THE INVENTION

In accordance with the present invention, an electrical bushing is provided. The electrical bushing includes an insulating body secured to a metal conductor having a first embossment region and a second embossment region. The first embossment region has a pattern of protuberances and the second embossment region has at least one annular ring. The protuberances of the first embossment region are not annular rings.

Also provided in accordance with the invention is a method of forming an electrical bushing. In accordance with the method, a metal conductor is provided having a first embossment region and a second embossment region. The first embossment region has a pattern of protuberances and the second embossment region has at least one annular ring. The protuberances of the first embossment region are not annular rings. A plastic insulating body is molded over the conductor.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
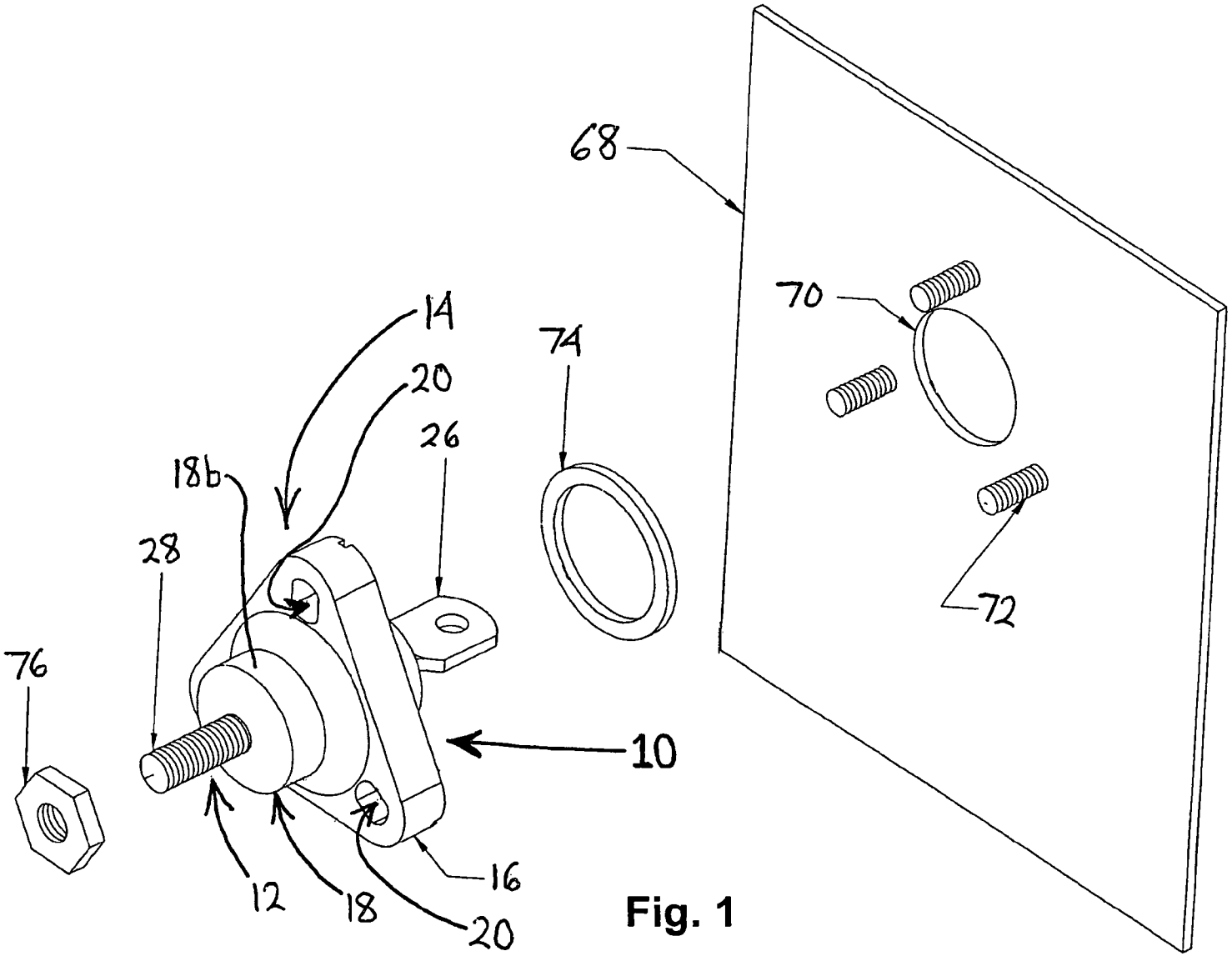
FIG. 1 shows an exploded view of an electrical bushing assembly disposed in front of a wall of an electrical device, wherein the electrical bushing assembly includes an electrical bushing constructed in accordance with a first embodiment of the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
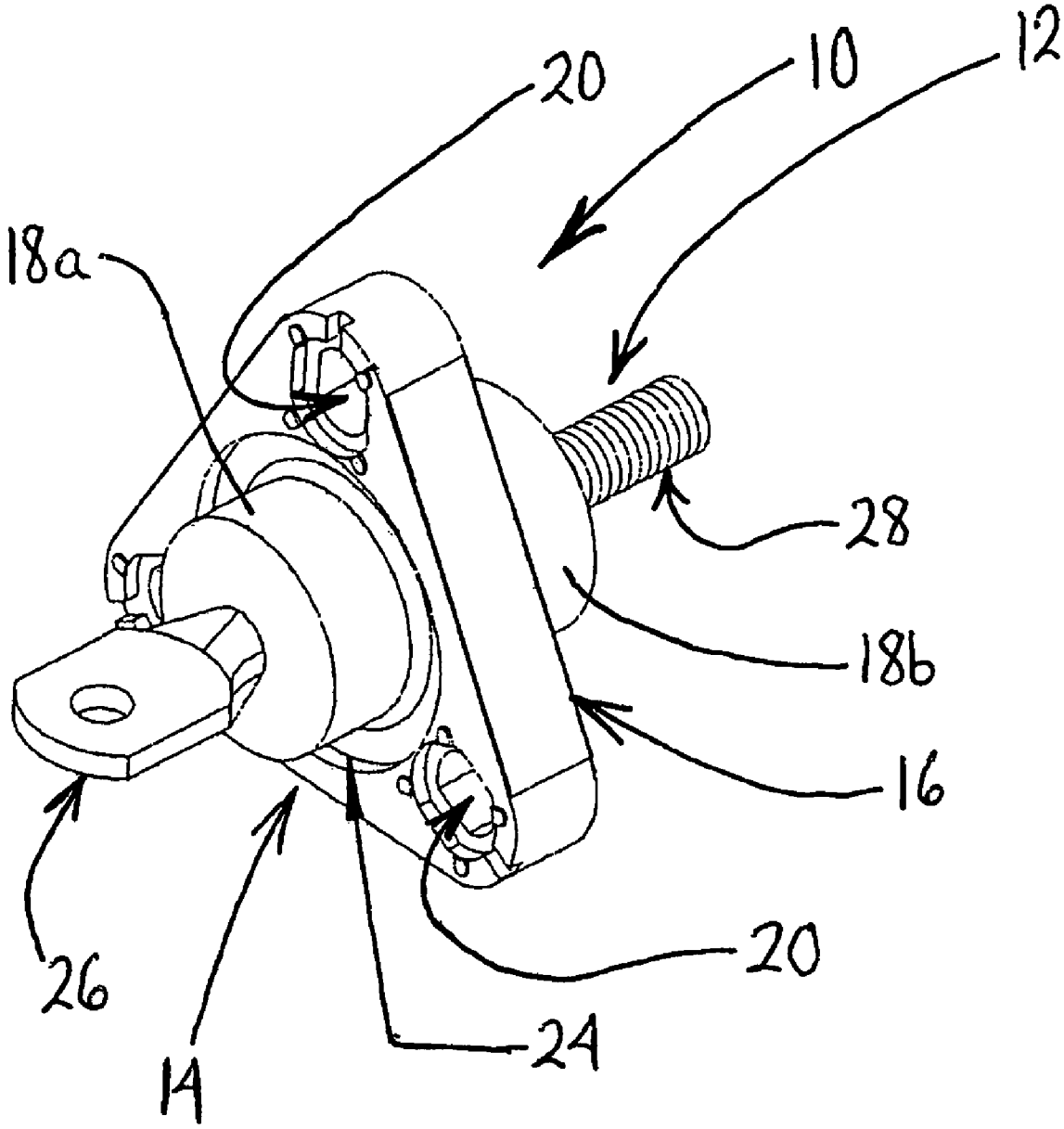
FIG. 2 shows an inner end perspective view of the electrical bushing of the first embodiment.

Referring now to FIGS. 1 and 2, there is shown an electrical bushing 10 constructed in accordance with a first embodiment of the present invention. The bushing 10 may be a low voltage bushing adapted for use in a distribution transformer.

The bushing 10 includes a conductor 12 and an insulating body 14. As will be described in more detail below, the insulating body 14 is molded around the conductor 12 in an injection over-molding process.

The insulating body 14 is composed of a dielectric plastic and more particularly a dielectric thermoplastic. Examples of dielectric thermoplastics that may be used to form the insulating body 14 include polyphthalamide or high temperature nylon (HTN), polyethylene terephthalate (PET) and polybutylene terephthalate (PBT). The insulating body 14 includes a triangular flange 16 disposed around a cylindrical main section 18. Mounting openings 20 are located at the three corners of the flange 16, respectively, and extend through the flange 16. At the juncture of the main section 18 and the flange 16, an annular recess 24 is formed in an inner surface 16*a* of the flange 16 and extends around the main section 18. As will be described below, the annular recess 24 functions as a gasket seat. The flange 16 divides the main section 18 into an inner portion 18*a* and an outer portion 18*b*.

Figure 3:
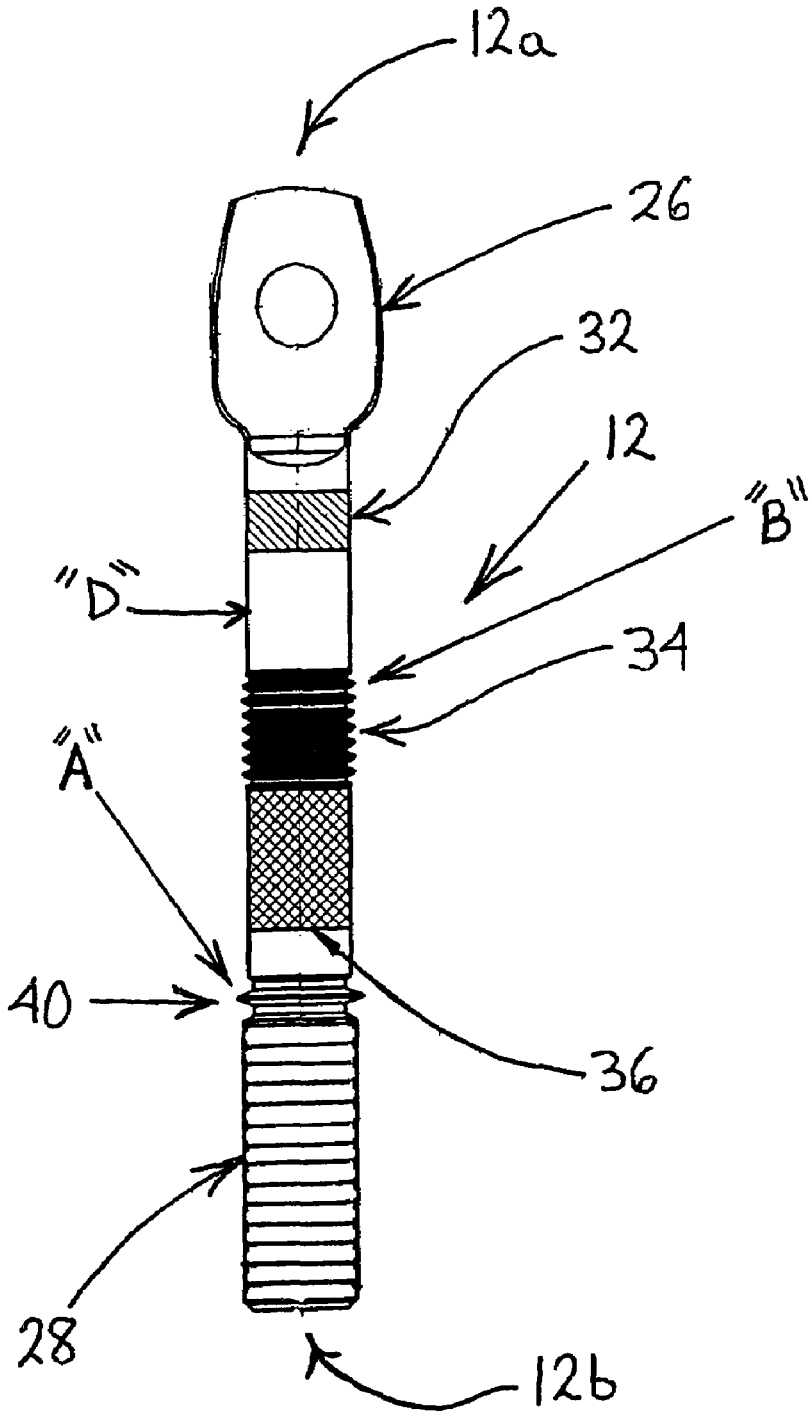
FIG. 3 shows a side view of a conductor of the electrical bushing of the first embodiment.
Figure 4:
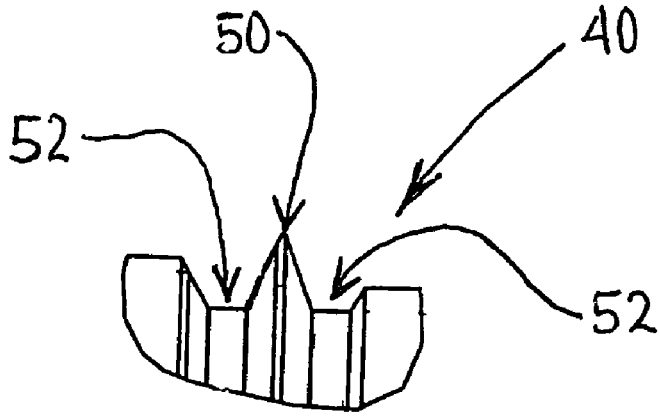
FIG. 4 shows an enlarged portion of the conductor of the electrical bushing of the first embodiment, the portion being identified by the letter "A" in FIG. 3.
Figure 5:
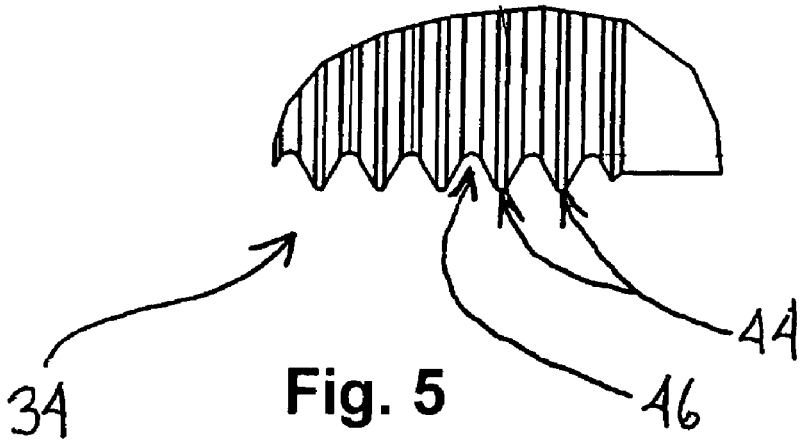
FIG. 5 shows an enlarged portion of the conductor of the electrical bushing of the first embodiment, the portion being identified by the letter "B" in FIG. 3.

Referring now to FIGS. 3, 4 and 5, the conductor 12 is elongated and has a first or inner end 12*a* and a second or outer end 12*b*. The conductor 12 is composed of a conductive metal, such as copper. The conductor 12 has a connection spade 26 at the inner end 12*a* and a threaded portion 28 at the outer end 12*b*. The threaded portion 28 has a continuous helical thread. Between the threaded portion 28 and the connection spade 26, a plurality of different embossment regions are formed in the conductor 12. More particularly, there is a first embossment region 32, a second embossment region 34, a third embossment region 36 and a fourth embossment region 40.

Figure 12:
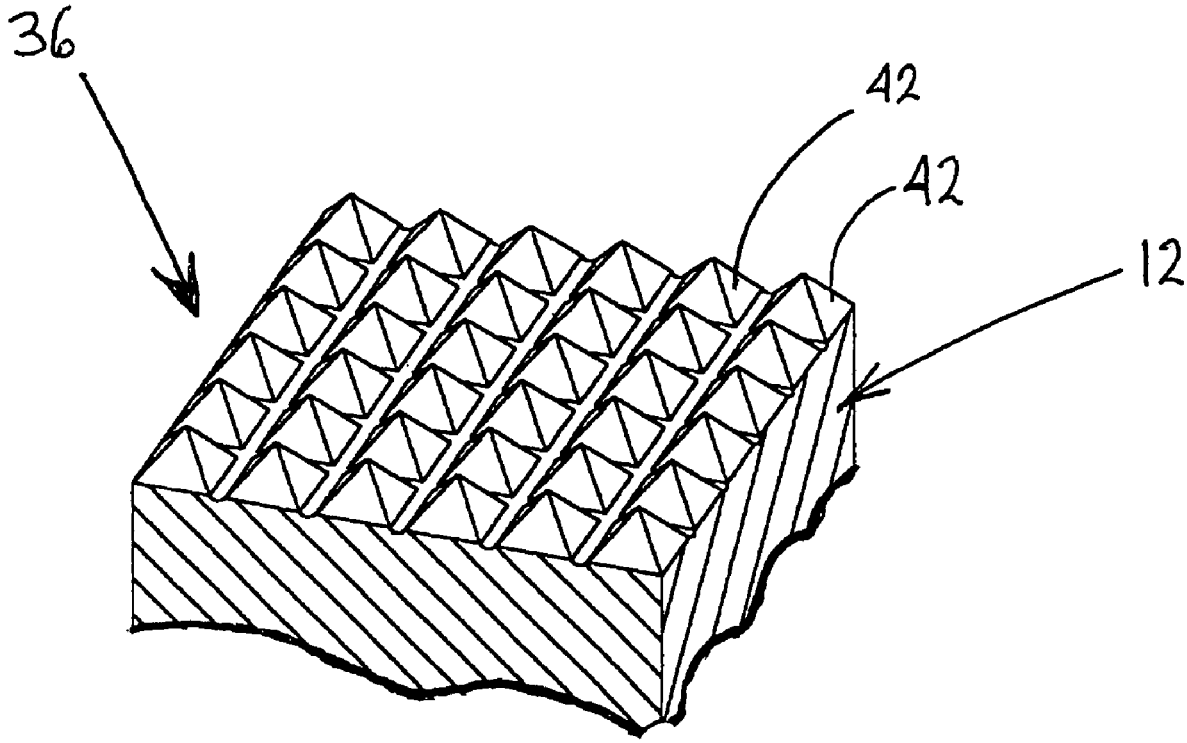
FIG. 12 shows an enlarged portion of an embossment region having diamond knurls.

The first embossment region 32 and the third embossment region 36 each comprise a pattern of protuberances that extend around the circumference of the conductor 12. The protuberances may be straight knurls, diagonal knurls, diamond knurls, dimples, or other types of projections raised from the surface of the conductor 12. Each individual protuberance does not extend around the circumference of the conductor 12, i.e., is not an annular ring. Straight knurls extend in a longitudinal direction of the conductor 12, while diagonal knurls extend obliquely to a longitudinal direction of the conductor 12. In the embodiment shown in FIGS. 1-6, the first embossment region 32 comprises diagonal knurls having 12 teeth per linear inch (TPI) and the third embossment region 36 comprises diamond knurls having 12 TPI with a 30° helix angle and a 90° tooth form. In this embodiment, the third embossment region 36 is more than twice as long as the first embossment region 32. A close up view of a portion of the third embossment region 36 is shown in FIG. 12. The protuberances comprise diamond knurls 42 that are spaced-apart and arranged in bands.

The second embossment region 34 comprises a plurality of annular rings 44 separated by a plurality of annular valleys 46. As expressed in TPI (where one ring 44 is considered a tooth), the rings 44 are provided in a quantity that is in a range of from about 10 TPI to about 14 TPI. The quantity and size of the rings 44 is dependent on the viscosity and flow properties of the dielectric plastic that makes up the insulating body 14. More particularly, the valleys 46 must be shallow enough to permit a dielectric plastic of a particular viscosity to flow into the valleys 46 and fill them during the molding process. In one embodiment, the insulating body 14 is composed of high temperature nylon and the rings 44 are provided in a quantity of 12 TPI. More particularly, in this embodiment, seven rings 44 are provided and the diameter of each of the rings 44 is about 0.611 inches and the diameter of the conductor 12 in each of the valleys 46 is about 0.518 inches. In this embodiment, the diameter of the conductor 12 at the location denoted by the "D" in FIG. 3 is 0.56 inches.

The fourth embossment region 40 has a single annular ring 50 disposed between two valleys 52. The ring 50 has a larger diameter than the rings 44. In the embodiment described above where the rings 44 each have a diameter of about 0.611 inches, the ring 50 has a diameter of about 0.699 inches and the diameter of the conductor 12 in each of the valleys 52 is 0.50 inches. During the molding process, the ring 50 forms a shut off point where the flow of molten plastic is pinched off, as will be described further below.

The threaded portion 28 and the first, second, third and fourth embossment regions 32-40 are all produced from a conductor blank (not shown) by roll forming. The conductor blank includes the connection spade 26 joined to a cylindrical body having a smooth outer surface. The body is deformed by different shaped rollers to form the threads in the threaded portion 28 and the different embossments of the first, second, third and fourth embossment regions 32-40.

Although the conductor 12 is shown as having four embossment regions (32-40), it should be appreciated that the conductor 12 may be provided with a greater or lesser number of embossment regions, or a different combination of different types of embossment regions. For example, the first embossment region 32 may be replaced with an embossment region having a singular annular ring with the same dimensions as the ring 50, or an embossment region having a plurality of annular rings having the dimensions and spacing of the rings 44. However, it has been found that a combination of at least one embossment region having knurls (such as diamond knurls) and at least one embossment region having at least one annular ring provides a robust sealing system.

Figure 6:
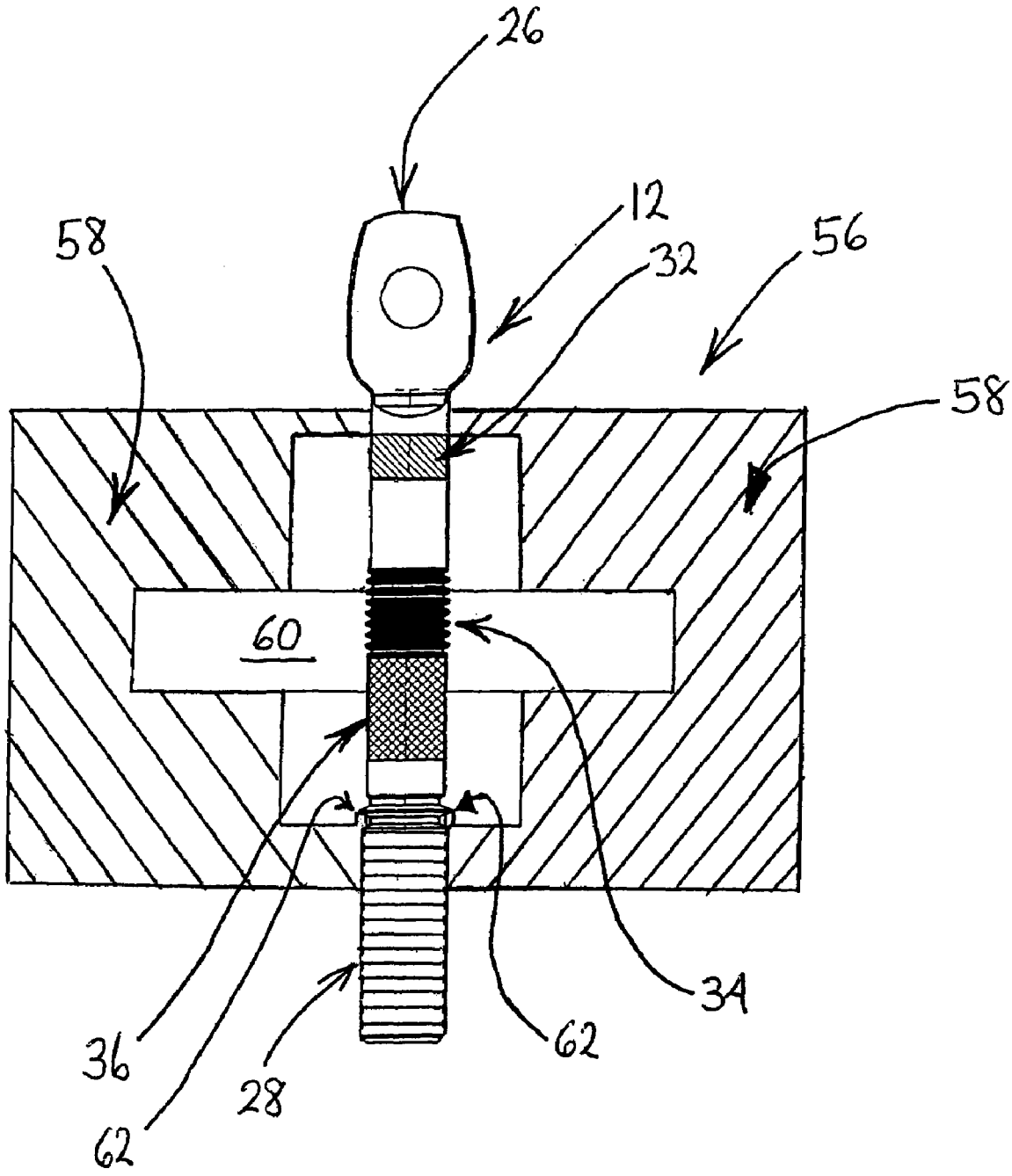
FIG. 6 shows a sectional view of a mold containing the conductor of the electrical bushing of the first embodiment.

Referring now to FIG. 6, the bushing 10 is formed by disposing the conductor 12 in a mold 56 of an injection molding machine. The mold 56 includes a pair of platens 58 (at least one of which is movable) that cooperate to define a cavity 60, which is configured to hold the conductor 12 and to shape the molten thermoplastic so as to form the insulating body 14 thereon. The conductor 12 is positioned such that the first, second, third and fourth embossment regions 32-40 are disposed in the cavity 60. Upper and lower portions pf the conductor 12 extend out of the cavity 60 through upper and lower passages formed between the two platens 58. The lower passages cooperate with the ring 50 to form shut off points 62 where the flow of molten thermoplastic is pinched off.

With the conductor 12 so disposed in the cavity 60, molten thermoplastic resin is injected into the cavity 60 under pressure. The molten thermoplastic flows over the conductor 12 and into the recesses of the first, second, third and fourth embossment regions 32-40. Thus, in the second embossment region 34, the molten thermoplastic flows into and fills the valleys 46. The molten thermoplastic also flows into and fills an uppermost one of the valleys 52 and flows around and over the ring 50 and is pinched off at the shut-off points 62. After a predetermined period of time, the injection of the molten thermoplastic into the cavity 60 is shut-off and the thermoplastic in the cavity 60 is allowed to cool. When the thermoplastic is sufficiently cooled, the mold 56 is opened and the conductor 12 with the insulating body 14 formed thereon is removed.

Referring back to FIG. 1, the fully constructed bushing 10 may be mounted to a wall 68 of an electrical device, such as a distribution transformer. The wall 68 includes a circular opening 70 through which the bushing 10 extends into the electrical device. Three threaded bolts 72 extend from the wall 68 and are disposed around the opening 70. The bolts 72 are arranged in a configuration that is substantially identical to the configuration of the mounting openings 20 in the flange 16 of the bushing 10. The bushing 10 is mounted to the wall 68 by first disposing an annular gasket 74 in the recess 24 of the flange 16 and then aligning the mounting openings 20 with the bolts 72, respectively. The bushing 10 is then moved inward toward the wall 68 so that the bolts 72 pass through the mounting openings 20 and the connection spade 26 and the inner portion 18*a* of the main section pass through the opening 70. When the gasket 74 contacts the wall 68, the inward movement of the bushing 10 is stopped and sets of mounting nuts and washers (not shown) are threadably disposed over the bolts 72, respectively, to secure the bushing to the wall 68. With the bushing 10 so mounted, the connection spade 26 is disposed inside the electrical device (e.g. a distribution transformer) and may be connected to an internal electrical component of the electrical device (e.g. low voltage leads). An external circuit may be connected to the conductor 12 of the bushing 10 using a brass contact nut 76, which is threadably disposed over the threaded portion 28 of the conductor 12.

The first, second, third and fourth embossment regions 32-40 provide both a mechanical connection and a gas tight seal between the conductor 12 and the insulating body 14.

Figure 7:
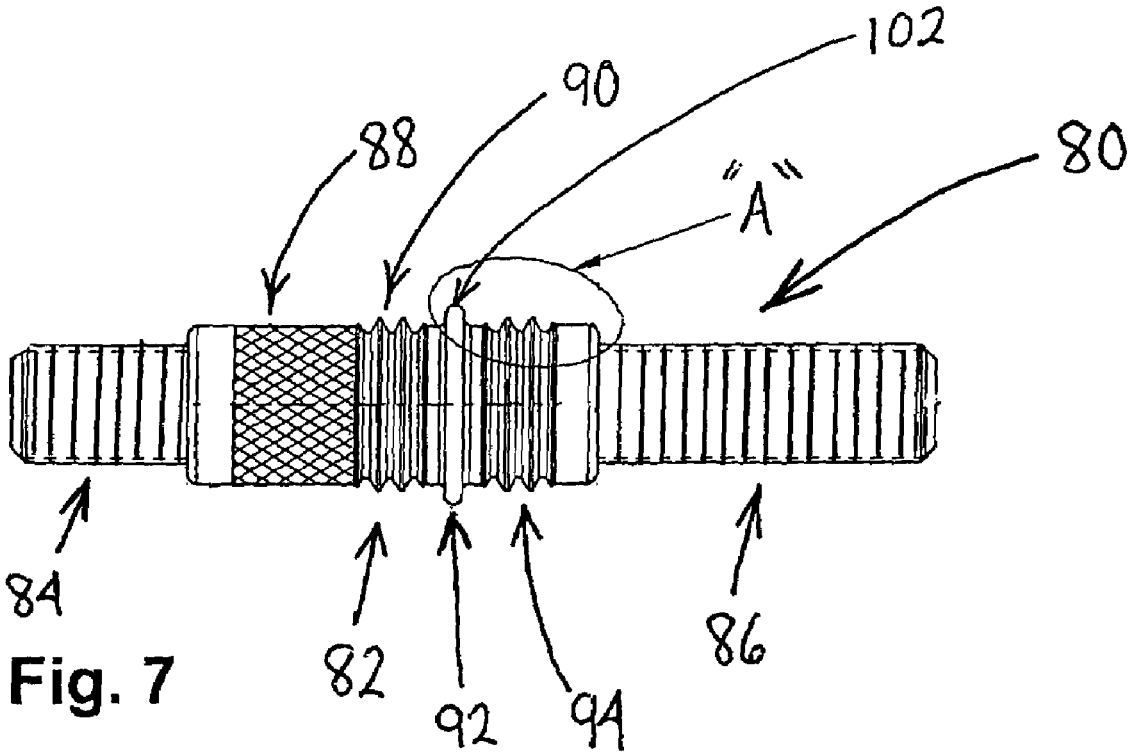
FIG. 7 shows a side view of a conductor of an electrical bushing constructed in accordance with a second embodiment of the present invention.
Figure 8:
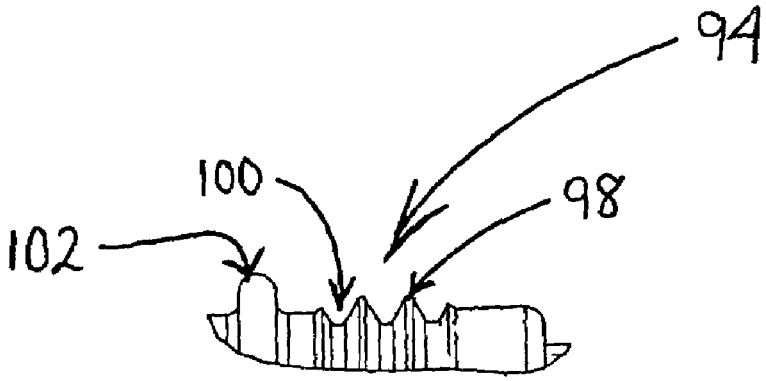
FIG. 8 shows an enlarged portion of the conductor of the electrical bushing of the second embodiment, the portion being identified by the letter "A" in FIG. 7.

Referring now to FIGS. 7 and 8, there is shown a conductor 80 of an electrical bushing constructed in accordance with a second embodiment of the present invention. An insulating body (not shown) is molded over the conductor 80.

The conductor 80 is composed of a conductive metal, such as copper. The conductor 80 is elongated and includes a middle section 82 disposed between a first threaded portion 84 and a second threaded portion 86. The first and second threaded portions 84, 86 each have a continuous helical thread. The middle section 82 includes a first embossment region 88, a second embossment region 90, a third embossment region 92 and a fourth embossment region 94. The first and second threaded portions 84, 86, and the first, second, third and fourth embossment regions 88, 90, 92 and 94 are all produced by roll forming.

The first embossment region 88 comprises a pattern of protuberances disposed around the circumference of the conductor 80. The protuberances may be straight knurls, diagonal knurls, diamond knurls, dimples, or other types of projections raised from the surface of the conductor 80. In the embodiment shown in FIGS. 7 and 8, the first embossment region 88 comprises diamond knurls having 12 TPI with a 30° helix angle and a 90° tooth form. The first embossment region 88 is produced by roll forming.

The second embossment region 90 and the fourth embossment region 94 each comprise a plurality of annular rings 98 separated by a plurality of annular valleys 100. As expressed in TPI (where one ring 98 is considered a tooth), the rings 98 are provided in a quantity that is in a range of from about 10 TPI to about 14 TPI.

The third embossment region 92 comprises a single annular ring 102. The ring 102 has a larger diameter than the rings 98. In one embodiment, the ring 102 has a diameter of 0.630 inches and the rings 102 each have a diameter of 0.549 inches.

Figure 9:
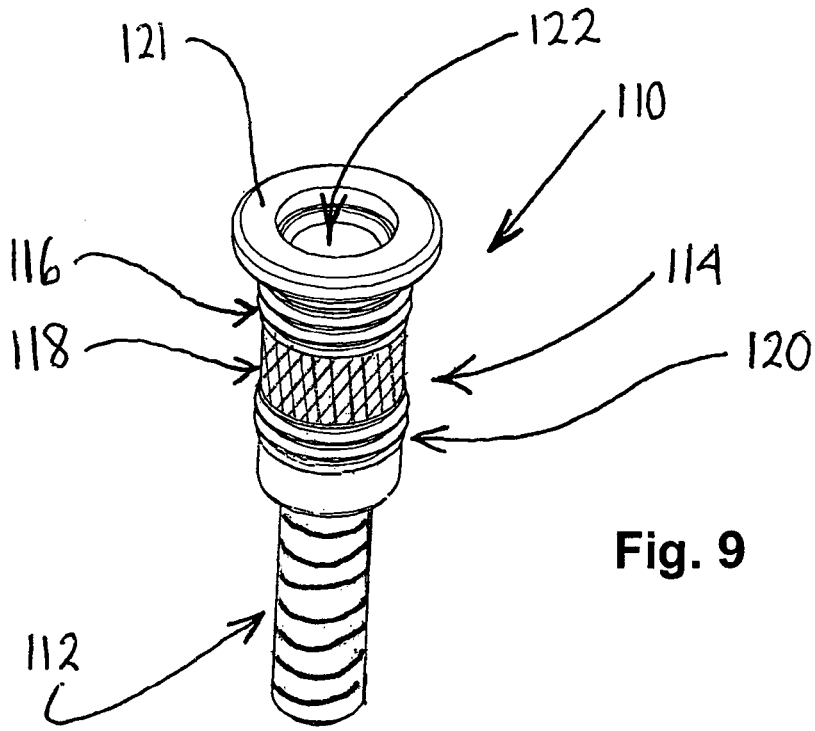
FIG. 9 shows a perspective view of a conductor of an electrical bushing constructed in accordance with a third embodiment of the present invention.
Figure 10:
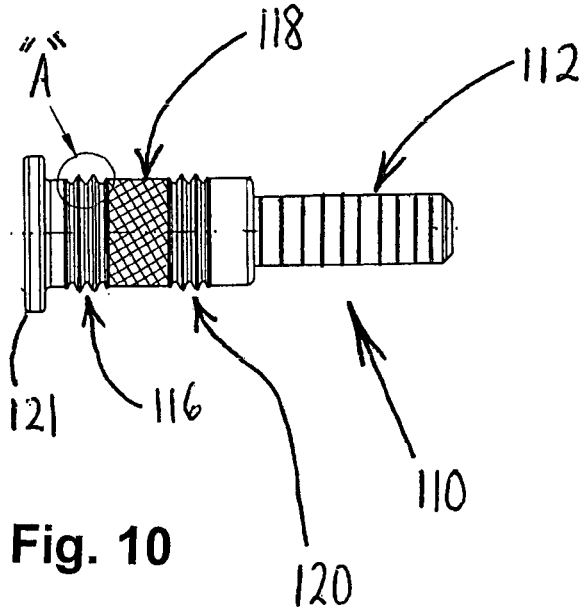
FIG. 10 shows a side view of a conductor of the electrical bushing of the third embodiment.
Figure 11:
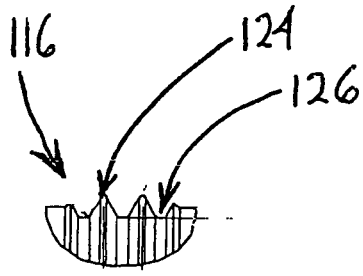
FIG. 11 shows an enlarged portion of the conductor of the electrical bushing of the third embodiment, the portion being identified by the letter "A" in FIG. 10.

Referring now to FIGS. 9, 10 and 11, there is shown a conductor 110 of an electrical bushing constructed in accordance with a third embodiment of the present invention. An insulating body (not shown) is molded over the conductor 110.

The conductor 110 is composed of a conductive metal, such as copper, and is elongated. The conductor 110 includes a threaded end portion 112 and a body portion 114 having a plurality of embossment regions. The threaded end portion 112 has a continuous helical thread. The body portion 114 has a first embossment region 116, a second embossment region 118 and a third embossment region 120. The threaded end portion 112, and the first, second, and third embossment regions 116, 118 and 120 are all produced by roll forming. An axially-extending bore 122 is formed in the body portion 114. An annular flange 121 is disposed around the bore 122 and is joined to the body portion 114.

The first and third embossment regions 116, 120 each comprise a plurality of annular rings 124 separated by a plurality of annular valleys 126. As expressed in TPI (where one ring 124 is considered a tooth), the rings 124 are provided in a quantity that is in a range of from about 10 TPI to about 14 TPI.

The second embossment region 118 comprises a pattern of protuberances disposed around the circumference of the conductor 110. The protuberances may be straight knurls, diagonal knurls, diamond knurls, dimples, or other types of projections raised from the surface of the conductor 110. In the embodiment shown in FIGS. 9 and 10, the second embossment region 118 comprises diamond knurls having 12 TPI with a 30° helix angle and a 90° tooth form. The second embossment region 118 is produced by roll forming.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An electrical bushing comprising:

a metal conductor having a first embossment region, a second embossment region and a third embossment region serarated from the first and second embossment regions, the first and third embossment regions each being comprised of a pattern of protuberances and the second embossment region comprising at least one annular ring, wherein the protuberances of the first embossment region are not annular rings; and an insulating body secured to the conductor and being disrosed over the first, second and third embossment regions.

2. The electrical bushing of claim 1, wherein the insulating body is comprised of a polymeric material.

3. The electrical bushing of claim 2, wherein the insulating body is comprised of a thermoplastic.

4. The electrical bushing of claim 3, wherein the thermoplastic is selected from the group consisting of high temperature nylon (HTN), polyethylene terephthalate (PET) and polybutylene terephthalate (PBT).

5. The electrical bushing of claim 1, wherein the first embossment region comprises diamond knurls.

6. The electrical bushing of claim 1, wherein the protuberances of the third embossment region are not annular rings.

7. The electrical bushing of claim 6, wherein the second embossment region is disposed between the first and third embossment regions.

8. The electrical bushing of claim 7, wherein the second embossment region comprises a plurality of annular rings.

9. The electrical bushing of claim 8, further comprising a fourth embossment region separated from the first, second and third embossment regions.

10. The electrical bushing of claim 1, wherein the insulating body is molded around the conductor in an injection over-molding process.

11. The electrical bushing of claim 1, wherein the conductor further comprises a threaded portion disposed outside the insulating body.

12. The electrical bushing of claim 1, wherein the conductor comprises a connection spade for connection to a lead of a transformer.

13. The electrical bushing of claim 12, wherein the insulating body comprises a cylindrical section joined to a flange adapted for securement to a wall of the transformer.

14. A method of forming an electrical bushing comprising:

providing a metal conductor having a first embossment region, a second embossment region and a third embossment region separated from the first and second embossment regions, the first and third embossment regions each being comprised of a pattern of protuberances and the second embossment region comprising at least one annular ring, wherein the protuberances of the first embossment region are not annular rings; and molding a plastic insulating body over the conductor so as to be disposed over the first, second and third embossment regions.

15. The method of claim 14, wherein the molding of the plastic insulating body comprises:

placing a portion of the conductor in a cavity of a mold; and injecting a molten thermoplastic resin into the cavity of the mold.

16. The method of claim 15, wherein the thermoplastic resin is selected from the group consisting of high temperature nylon (HTN), polyethylene terephthalate (PET) and polybutylene terephthalate (PBT).

17. The method of claim 14, wherein the first embossment region of the conductor comprises diamond knurls.

18. The method of claim 14, wherein the protuberances of the third embossment region are not annular rings.

19. The method of claim 14, wherein the provision of the conductor comprises forming the first and second embossment regions by roll forming.

* * * * *